US007582997B2

(12) United States Patent
Rojo Lulic

(10) Patent No.: US 7,582,997 B2
(45) Date of Patent: Sep. 1, 2009

(54) ARRANGEMENT FOR CONVEYING FLUIDS

(75) Inventor: Francisco Rojo Lulic, St. Georgen (DE)

(73) Assignee: EBM-PAPST St. Georgen GmbH & Co. KG, St. Georgen (DE)

( * ) Notice: Subject to any disclaimer, the term of this patent is extended or adjusted under 35 U.S.C. 154(b) by 195 days.

(21) Appl. No.: 11/570,679

(22) PCT Filed: Sep. 30, 2005

(86) PCT No.: PCT/EP2005/010565

§ 371 (c)(1),
(2), (4) Date: Dec. 15, 2006

(87) PCT Pub. No.: WO2006/056262

PCT Pub. Date: Jun. 1, 2006

(65) Prior Publication Data

US 2008/0061638 A1 Mar. 13, 2008

(30) Foreign Application Priority Data

Nov. 23, 2004 (DE) ..... 20 2004 018 753 U

(51) Int. Cl.
*H02K 9/06* (2006.01)

(52) U.S. Cl. ..... 310/103; 310/104; 310/105; 310/62

(58) Field of Classification Search ..... 310/103, 310/62, 104, 105; 417/420
See application file for complete search history.

(56) References Cited

U.S. PATENT DOCUMENTS 2,120,914 A * 6/1938 Vogel ..... 310/54
2,830,541 A * 4/1958 Higgins et al. ..... 417/357
4,013,384 A * 3/1977 Oikawa ..... 417/368
4,047,847 A * 9/1977 Oikawa ..... 417/370
4,752,194 A * 6/1988 Wienen et al. ..... 417/420
4,890,988 A * 1/1990 Kramer et al. ..... 417/372
5,017,102 A * 5/1991 Shimaguchi et al. ..... 417/420
5,066,200 A * 11/1991 Ooka ..... 417/63
5,248,245 A * 9/1993 Behnke et al. ..... 417/366
5,641,275 A * 6/1997 Klein et al. ..... 417/420

(Continued)

FOREIGN PATENT DOCUMENTS

DE 87-11555 U 10/1987

(Continued)

*Primary Examiner*—Quyen Leung
*Assistant Examiner*—Naishadh N Desai
(74) *Attorney, Agent, or Firm*—Milton Oliver, Esq.; Oliver Intellectual Property LLC

(57) ABSTRACT

An arrangement for conveying fluids has a fluid pump (174) having a rotatably journaled pump wheel (172) that is joined to a first permanent magnet (186) and an electronically commutated internal-rotor motor (152) having a stator (154) and a rotor (156), as well as a shaft (160) associated with the latter, which shaft is journaled rotatably relative to the stator (154). The arrangement also has a second permanent magnet (184) joined nonrotatably to the rotor (156), which magnet coacts with the first permanent magnet (186) to serve as a magnetic coupling. A separating can (170, 180, 188) hermetically separates the first permanent magnet (186) arranged inside the separating can, from the second permanent magnet (184) arranged outside the separating can. A fan wheel (218) mounted on the motor shaft, provides cooling air.

16 Claims, 2 Drawing Sheets

U.S. PATENT DOCUMENTS

Figure 1:
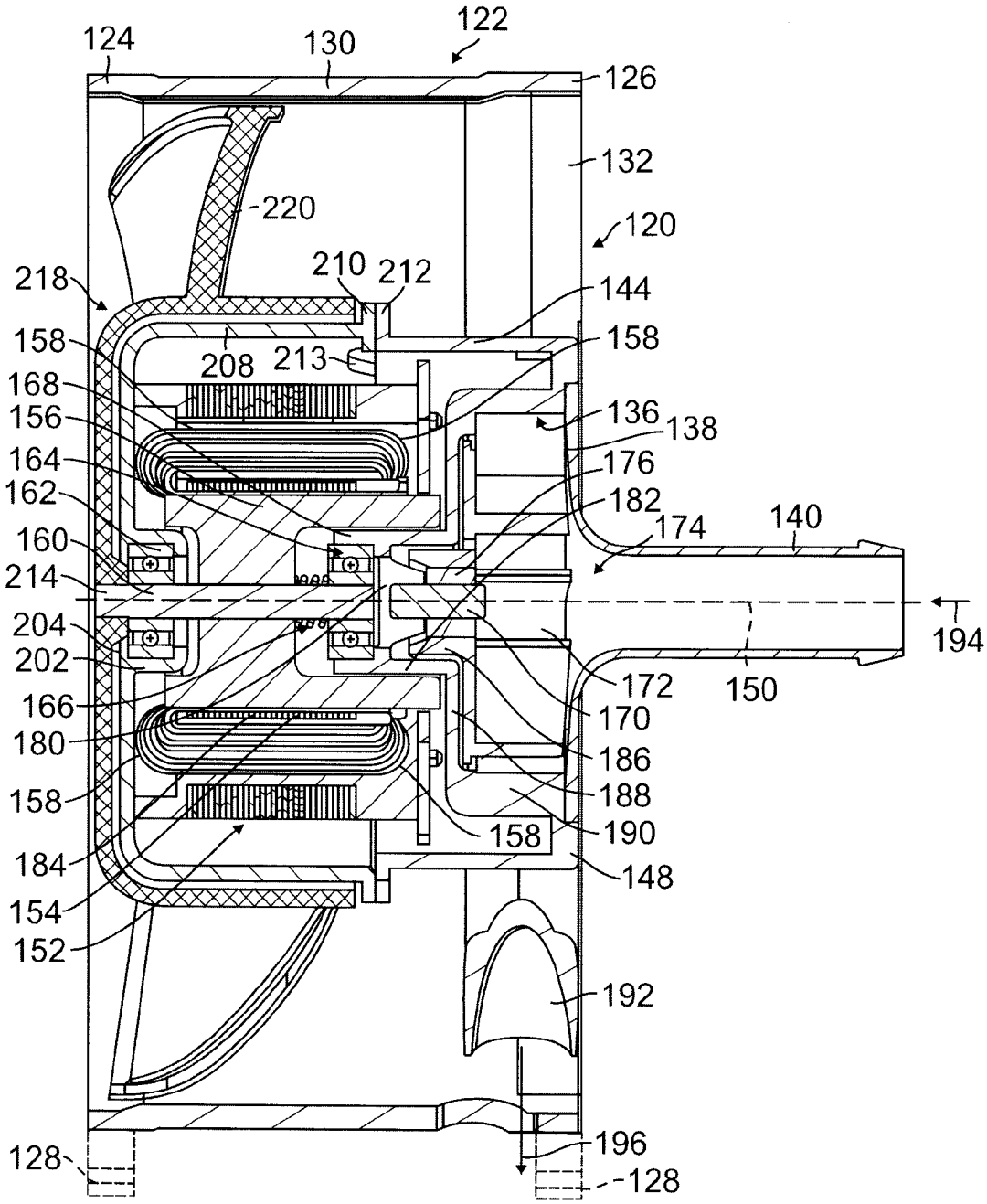

| | | | | |
|---|---|---|---|---|
| 5,964,028 | A * | 10/1999 | Buse | 29/598 |
| 6,208,512 | B1 | 3/2001 | Goldowsky et al. | 361/699 |
| 6,264,440 | B1 * | 7/2001 | Klein et al. | 417/420 |
| 6,280,156 | B1 * | 8/2001 | Wirz et al. | 417/420 |
| 6,600,649 | B1 | 7/2003 | Tsai et al. | 361/697 |
| 7,262,532 | B2 * | 8/2007 | Seidler et al. | 310/103 |
| 2006/0032625 | A1 | 2/2006 | Angelis et al. | 165/247 |

FOREIGN PATENT DOCUMENTS

| | | | |
|---|---|---|---|
| DE | 38 12 926 | A | 10/1989 |
| DE | 3812926 | A1 * | 10/1989 |
| DE | 103 44 699 | A | 4/2004 |
| EP | 0 510 362 | A | 10/1992 |
| JP | 62-147095 | | 7/1987 |

* cited by examiner

ARRANGEMENT FOR CONVEYING FLUIDS

CROSS-REFERENCE

This application is a section 371 of PCT/EP2005/10565, filed 20 Sep. 2005, published as WO 2006-56262-A on 1 Jun. 2006, and claims priority from DE 20 2004 018 752.1, filed 23 Nov. 2004.

FIELD OF THE INVENTION

The present invention relates to an arrangement for conveying fluids, e.g. liquid and/or gaseous media.

BACKGROUND

Components having high heat flux densities, e.g. 60 $W/mm^2$, are used today in computers. Heat from these components must first be transferred into a liquid circuit, and from there must be delivered via a liquid/air heat exchanger to the ambient air.

The discharge of heat from components having a high heat flux density is accomplished by means of so-called heat absorbers or cold plates. In these, heat is transferred to a cooling liquid, and the latter is usually caused to circulate, in forced fashion, in a closed circuit.

In this context, the cooling liquid flows through not only the heat absorber, but also a liquid pump that effects the forced circulation and brings about a suitable pressure buildup and volume flow through the heat absorber and an associated heat exchanger, so that the heat transfer coefficients pertinent to these heat exchangers become large, and the temperature gradients necessary for heat transfer become small.

A fan, which brings about forced convection of the cooling air on the air side of the heat exchanger as well as good transfer coefficients, is usually arranged on the heat exchanger.

Because of the limited space in most electronic devices, the pump and fan must be arranged in as space-saving a fashion as possible, i.e. a compact design is desirable.

SUMMARY OF THE INVENTION

It is therefore an object of the present invention to make available a novel arrangement for conveying fluids and air to cool the fluids.

According to the invention, this object is achieved by arranging a centrifugal pump close enough to a fan motor for magnetic coupling between them, but hermetically separated from each other by a separating can structure. A compact arrangement with good efficiency is thereby obtained. It is particularly advantageous in this context that the motor may have a length that is long in relation to the arrangement, enabling a correspondingly high motor output.

The rotor of the arrangement is preferably implemented as a permanent-magnet rotor, which makes possible a compact design, especially when the second permanent magnet is implemented integrally with the permanent-magnet rotor.

A design that is particularly short axially results from configuring the fan-side magnet of the magnetic coupling to extend around one of the motor's rotary bearings and arranging the pump-side magnet of the magnetic coupling to extend axially partially within the fan-side magnet, since as a result thereof, the fan bearing (for the rotor shaft) arranged outside the separating can thereon is located at least in part inside the fan rotor, without negatively affecting the function of the motor or of the magnetic coupling.

Another preferred manner of achieving the stated object is to form the fan-side magnet of the coupling pair as an extension of the fan motor's permanent-magnet rotor. It enables a compact, space-saving design with simple and economical assembly.

BRIEF FIGURE DESCRIPTION

Further details and advantageous refinements of the invention are evident from the exemplifying embodiment, in no way to be understood as a limitation of the invention, that is described below and depicted in the drawings.

Figure 2:
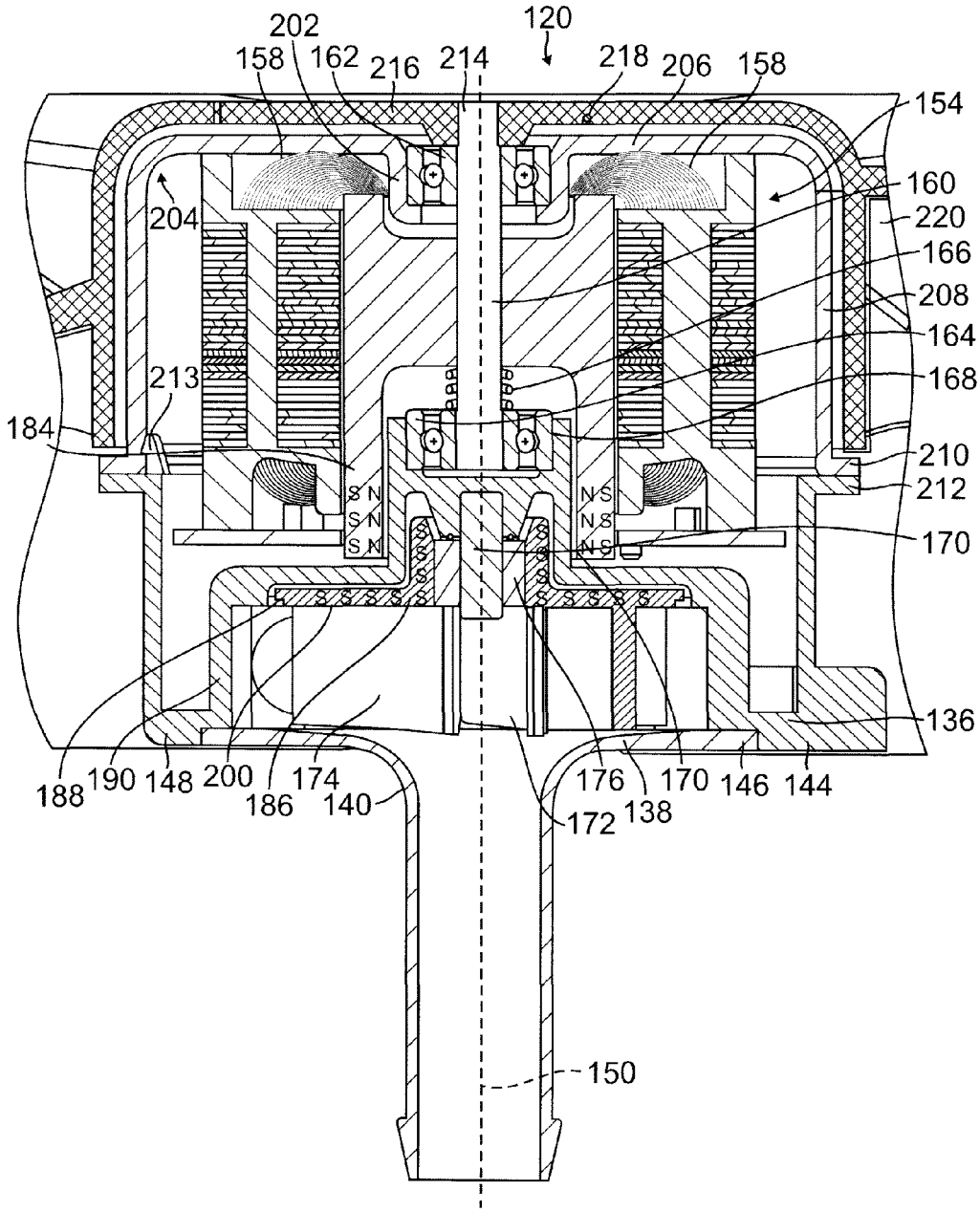

FIG. 1 is a longitudinal section through a preferred embodiment of an arrangement according to the present invention; and FIG. 2 is an enlarged detail of FIG. 1.

DETAILED DESCRIPTION

FIG. 1 is a longitudinal section through an arrangement 120 according to the present invention. The latter has externally an approximately cylindrical fan housing 122 having two flanges 124, 126, at each of whose corners is located a mounting orifice 128, and which are joined to one another by a tubular part 130.

Flange 126 is joined by struts or spokes 132 to a cover 138 of a pump housing 136. An inlet tube 140 is located on cover 138. Cover 138 is joined in liquid-tight fashion to housing 136 in the manner indicated.

Cylindrical peripheral portion 144 transitions, to the right in FIG. 1, into a portion 148 that extends perpendicular to longitudinal axis 150 of arrangement 120. This longitudinal axis 150 corresponds to the rotation axis of an electronically commutated internal-rotor motor 152 whose stator is labeled 154, and whose cup-shaped rotor is labeled 156. Winding elements of stator 154 are labeled 158. An advantage of arrangement 120 is that stator 154 and rotor 156 can be long in relation to arrangement 120, i.e. that a high-output motor 152 can be used.

Rotor 156 is mounted on a shaft 160 that has, for its journaling, a left bearing 162 (referring to FIG. 1) and a right bearing 164. For reasons of service life, these are preferably rolling bearings. The inner ring of left rolling bearing 162 is mounted on shaft 160. The inner ring of right rolling bearing 164 is arranged displaceably relative to the shaft and is braced by an elastic compression spring 166 relative to rotor 156; this spring therefore pushes the inner ring of rolling bearing 164 to the right while it pushes the inner ring of rolling bearing 162 to the left, in order to ensure quiet running of arrangement 120.

The outer ring of rolling bearing 164 is mounted in a tube-like extension 168 of housing 136, which can also be referred to as bearing tube 168. A short shaft 170 for a pump wheel 172 of a centrifugal pump 174 is mounted in housing 136 opposite bearing 164, in the manner depicted. Pump wheel 172 is equipped for this purpose with a sintered bearing 176 that slides on the stationary shaft 170 and forms with it a plain bearing.

Shaft 170 is mounted on a portion 180 of housing 136, which portion extends approximately perpendicular to longitudinal axis 150. It transitions into a cylindrical part 182 that extends between a hollow-cylindrical permanent-magnet portion 184 of rotor 156 and a hollow-cylindrical extension 186 of pump wheel 172. As depicted, hollow-cylindrical portion 184 overlaps bearing 164, resulting in a very compact design.

Cylindrical part 182 of housing 136 in turn transitions into an annular portion 188 that proceeds perpendicular to longitudinal axis 150, and the latter portion transitions in turn into a portion 190 that extends around the outer periphery of pump wheel 176 and transitions into portion 148.

Portions 180, 182, and 188 of housing 136 form a so-called separating can. Because housing 136 is manufactured from plastic, it acts like air in terms of magnetic flux lines but is by nature fluid-tight, so that liquid that flows through inlet 140 into fluid pump 174 is transported by that pump and flows back out through an outlet 192, as indicated by arrows 194, 196, and cannot emerge out of pump 174.

As depicted in FIG. 2, hollow-cylindrical extension 186 of pump wheel 174 is radially magnetized, for example with four poles, usually with the same number of poles as rotor 156. A magnetic coupling is thereby produced between extension 184 of permanent-magnet rotor 156 and extension 186 of pump wheel 172; and when rotor 156 rotates during operation, that rotation is transferred by magnetic coupling 184, 186 to pump wheel 172, so that the latter likewise rotates.

As FIG. 2 shows, pump wheel 172 also has an annular-disk-shaped portion 200 that is implemented as a permanent magnet, and that coacts with the magnetic leakage field at the lower end of rotor 156 and likewise constitutes part of the magnetic coupling, i.e. transfers part of the torque from rotor 156 to pump wheel 172.

Upper bearing 162 (in FIG. 2) of rotor 156 is arranged in a collar 202 of a housing part 204 that, as depicted, can be pot-shaped. This collar transitions, via a kind of bearing bell 206, into a cylindrical portion 208 that encloses most of stator 154 and ends at a flange 210 that is joined to a flange 212 of housing part 144, for example, as depicted, via a latching connection by means of multiple latching hooks 213, only one of which is depicted. The latter are preferably attached on the radially inner side of flange 212, and make possible very simple assembly.

Collar 202 is located in a depression of housing part 204, and shaft end 214 of shaft 160 projects out of said depression. Pressed onto this shaft end 214, as depicted, is hub 216 of a pot-like fan wheel 218, on which fan blades 220 are arranged in the usual way. This fan wheel 218 thus, as it rotates, transports air in an axial direction through fan housing 122, and this air is preferably used to cool a liquid cooler for the fluid from fluid pump 174. The fan can, if necessary, also be implemented e.g. as a diagonal or radial fan.

Numerous variants and modifications are of course possible within the scope of the present invention.

What is claimed is:

1. An arrangement for conveying fluids that comprises a fluid pump (174), implemented as a centrifugal pump, having a rotatably journaled pump wheel (172) that is joined to a first permanent magnet (186);

an electronically commutated internal-rotor motor (152) having a stator (154) and a rotor (156);

a shaft (160) associated with the rotor (156), which shaft is journaled, using a pair of bearings (162, 164), rotatably relative to the stator (154);

a second permanent magnet (184) joined nonrotatably to the rotor (156), which magnet coacts with the first permanent magnet (186) to thereby function as a magnetic coupling;

a separating can (170, 180, 188) that hermetically separates the first permanent magnet (186) of the magnetic coupling, arranged inside said separating can, from the second permanent magnet (184) arranged outside the separating can, one of said bearings (164) for the shaft of the rotor (156) being arranged outside the separating can thereon;

a support arrangement (204), joined to the stator (154), for another of the bearings (162) of the shaft (160) of the rotor (156);

and a fan wheel (218), equipped with fan blades (220), that is joined nonrotatably to a rotor shaft end region (214), facing away from the separating can (170, 180, 188), of the shaft (160) of the rotor (156).

2. The arrangement according to claim 1, wherein the rotor is implemented as a permanent-magnet rotor (156).

3. The arrangement according to claim 2, wherein the second permanent magnet (184) is implemented integrally with the permanent-magnet rotor (156).

4. The arrangement according to claim 1, wherein the permanent-magnet rotor (156), together with the second permanent magnet (184) arranged thereon, at least partly overlaps a pump-adjacent one (164) of said motor bearings, arranged outside the separating can (170, 180, 188), said motor bearing being arranged on said separating can.

5. The arrangement according to claim 1, wherein a bearing structure for the rotor (156) of the internal-rotor motor (152) further comprises a bearing tube (168) that is fixedly joined to the separating can (170, 180, 188).

6. The arrangement according to claim 5, wherein the bearing tube (168) is implemented integrally with the separating can (170, 180, 188).

7. The arrangement according to claim 4, wherein said bearing support arrangement at least locally surrounds the stator (154) and extends outside the stator as a bearing bell (204) in which the other bearing (162) is arranged.

8. The arrangement according to claim 1, wherein the fan wheel (218) comprises a pot-like arrangement which extends approximately parallel to the outer periphery of the stator (154), and fan blades (220) are arranged on an outer periphery of said fan wheel.

9. The arrangement according to claim 1, wherein the fluid pump (174) further comprises a cover (138) equipped with an inlet conduit (140) for ingress of said fluid.

10. The arrangement according to claim 4, wherein the bearing (164), arranged on the separating can (170, 180, 188), for the shaft (160) of the rotor (156) is implemented as a rolling bearing, and the shaft (160) is arranged displaceably, radially within the inner ring of that rolling bearing (164).

11. The arrangement according to claim 7, wherein an elastic member (166) is provided between the inner ring of the rolling bearing (164) and the rotor (156), which member exerts on said inner ring an axial force, relative to the rotor (156).

12. An arrangement for conveying fluids that comprises a fluid pump (174), implemented as a centrifugal pump, having a pump wheel (172) that is joined to a first permanent magnet (186)

an electronically commutated internal-rotor motor (152) having a stator (154) and a permanent-magnet rotor (156);

a shaft (160) associated with the rotor (156), which shaft is journaled on bearings (162, 164) rotatably, relative to the stator (154);

a separating can (170, 180, 188) that surrounds in fluid-tight fashion the first permanent magnet (186) arranged inside that separating can, a first bearing (164) for the shaft of the rotor (156) being arranged on an outer side of the separating can thereon;

a support arrangement (204) , joined to the stator (154) , for a second bearing (162) of the shaft (160) of the rotor (156);

a fan wheel (218), equipped with fan blades (220), that is joined nonrotatably to an end region (214) , facing away from the separating can (170, 180, 188), of the shaft (160) of the rotor (156) ; and a second permanent magnet (184) implemented as an extension of the permanent-magnet rotor (156), which magnet overlaps the first bearing (164) , coacts with the first permanent magnet (186) in the manner of a magnetic coupling, and is hermetically separated from the first permanent magnet (186) by the separating can (170, 180, 188).

13. The arrangement according to claim 12, wherein the second permanent magnet (184) is implemented integrally with the permanent-magnet rotor (156).

14. arrangement according to claim 12 wherein the first bearing (164) is implemented as a rolling bearing, and the shaft (160) is arranged axially displaceably, radially within the inner ring of that rolling bearing (164).

15. The arrangement according to claim 14, wherein an elastic member (166) is provided between the inner ring of the rolling bearing (164) and the rotor (156), which member exerts, on said inner ring, an axial force relative to the rotor (156).

16. The arrangement according to claim 13, wherein a first one (164) of said bearings comprises a bearing tube (168) that is joined to an outer surface of the separating can (170, 180, 188).

* * * * *